US005533358A

United States Patent [19]

Crandall et al.

[11] Patent Number: 5,533,358

[45] Date of Patent: Jul. 9, 1996

[54] REFRIGERANT RECOVERING SYSTEM

[75] Inventors: Thomas L. Crandall; Donald W. Strout, both of York, Pa.; Eigil Hansen, Sønderborg, Denmark

[73] Assignee: A'Gramkow A/S, Sonderborg, Denmark

[21] Appl. No.: 203,367

[22] Filed: Mar. 1, 1994

[51] Int. Cl.[6] ..... F25B 45/00

[52] U.S. Cl. ..... 62/292; 62/475

[58] Field of Search ..... 62/292, 77, 475, 62/85, 50.5; 55/267, DIG. 17; 95/288; 96/193, 201, 218

[56] References Cited

U.S. PATENT DOCUMENTS 5,094,087 3/1992 Gramkow .
5,161,385 11/1992 Schumacher ..... 62/475
5,167,126 12/1992 Cartwright ..... 62/475
5,193,358 3/1993 Winter ..... 62/470
5,361,594 11/1994 Young ..... 62/475

*Primary Examiner*—John M. Sollecito
*Attorney, Agent, or Firm*—Antonelli, Terry, Stout & Kraus

[57] ABSTRACT

A system for recovering and refining volatile liquids such as refrigerants includes a suction accumulator which serves as a precleaning module. The accumulator has an intake for contaminated fluids. A compressor having a suction side thereof is connected to the suction accumulator, while a discharge side thereof is connected to a condenser which, in turn, delivers the condensed liquid gas to a collector tank. A filter removes contaminants from the fluid flow in the connection between the suction accumulator and the collector tank. Precleaning of the intake fluid in the suction accumulator is accomplished by cold surface distillation to remove contaminants. Efficient distillation of the intake fluid is achieved from the beginning of the recovery of the volatile fluid by diffusing the incoming fluid over a cold surface of an evaporating refrigerant provided as a precharge in the suction accumulator.

17 Claims, 1 Drawing Sheet

REFRIGERANT RECOVERING SYSTEM

BACKGROUND OF THE INVENTION

Figure 1:
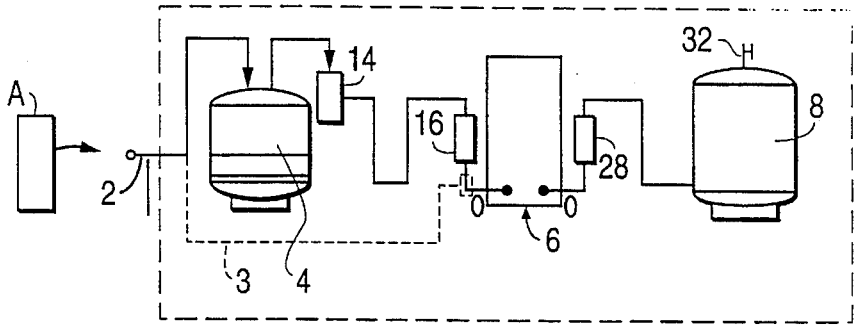

The present invention relates to a method and a system for recovery of refrigerants or other volatile liquids from closed working circuits, e.g. from refrigeration units to be scrapped or repaired, or for purifying the refrigerant of a given system and then returning it to the same system for re-use. Care should be taken to prevent the gases from escaping to the atmosphere, where they are highly undesired. Normally, used refrigerants are polluted, e.g. by water and oil, and for enabling them to be reused it is required to subject them to an effective purification.

These problems have already been described and discussed in detail in many patent specifications, of which a few examples are the U.S. Pat. Nos. 4,285,206, 4,441,330, and 4,476,688. Of still higher relevance is the U.S. Pat. No. 5,094,087, belonging to the present assignee. According to the latter specification it is proposed that the recovery system comprises a suction inlet separator container, also called a suction accumulator, connected with the suction side of a compressor and with an intake conduit for connection with the external system, the regrigerant of which is to be recovered and reclaimed. Thus, as usual, the refrigerant is recovered in its gaseous phase and supplied to the compressor, from the discharge side of which it is supplied to a cleaning system including filter means for extracting moisture and other impurities from the gaseous refrigerant, whereafter the purified gas is delivered to a condenser that enables the refrigerant to be supplied to a collector tank for purified, liquid refrigerant.

It has been found, in that connection, that it is easier and better to purify the refrigerant in its gaseous state rather than in its liquid state, and this is still held to be true, generally.

There are four main contaminants in the refrigerants, viz. oil, acid, water and air, besides particular impurities, and in the prior art it has been a natural tendency to seek to improve the relevant separation means for each of these contaminants, for example resulting in quite effective and specialized oil and water filtration units. Over the recent years, however, the requirements as to the degree of purification of the reclaimed refrigerants have been ever rising, and it has been found that the highly developed filter units for the respective contaminants are not always as effective as desired or as believed.

In connection with the present invention, it has been found that when it comes to really high requirements as to the purification it is no longer possible to rely on the use of respective unitary filtration units for the different contaminants, at least as far as the oil, the acid, and the water are concerned. In fact, the picture becomes very complex when it is desired to improve further the purification at the higher end of the scale, for example speaking of purities higher than 99%. Prior purification systems may well have operated satisfactorily for removing as much as 95% of the contaminants, based on the effect of the respective specialized separator means, but in the very last end of the scale this is not at all sufficient.

Thus, it has been found that while good oil and acid filter units may remove, say, 95% of the contaminants attempts of improving further the units generally fail, because the filter units tend to become selective. Sometimes they operate with high efficiency, yet other times they are not so effective. Apparently, they—or rather the whole system—become sensitive to the detailed composition of the recovered contaminated refrigerant as well as to the ambient temperature.

BRIEF SUMMARY OF THE INVENTION

It has now been realized that in order to carry out a highly efficient purification of the most common or typical kinds of contaminated refrigerants it is required to make use of a whole series of specialized separators or filters, not necessarily specialized for the respective single contaminants, but rather operating by different principles for various combinations of contaminants whereby it is possible to cope with a very wide variety of compositions.

The invention is based on profound studies of the character of typically contaminated refrigerants and other volatile liquids, and as far as the refrigerants are concerned it has been found that the oil contaminant is not just "oil", but many types of oil, some heavier and some lighter than water. Correspondingly, "acid" is not just acid, but both relatively light organic acids as well as hydrochloric acid. Even water is a difficult contaminant which is not easily dealt with by a single separator or filter unit at any ambient temperature when it is desired to reach a final product having a very high degree of purity.

Several novel separator/filter units have been developed in connection with the invention, but they may well be used in combination with certain known devices in order to provide for an almost universally applicable purification system of extremely high efficiency. Remarkable improvements may be achieved already with the use of one or more of the novel units in combination with known units, so the invention will comprise not only the total of the disclosed super-effective system, but also less sophisticated systems derived therefrom.

According to one aspect of the invention it is realized that the efficiency of the purification system is highly dependant on the recovered refrigerant being handled and treated under substantially stable physical conditions during the various stages of the process. This is of particular importance in connection with the very typical handling of successive, relatively small volumes of refrigerant, because, at the intake end of the system, the temperature will be relatively high just before the suction intake of the refrigerant is initiated, while, thereafter, it will be lowered gradually owing to the associated evaporation of the refrigerant such that, soon after start-up, the temperature of the sucked-in gas will be stabilized at a low level. However, when the total volume is small this initial phase will represent a noticeable fraction of the entire treating time, and if or when the following purification units are optimized to operate based at a low starting temperature then it will adversely affect the efficiency of such units if the temperature is not at the low level right from the beginning.

On this background, it is proposed by the present invention to ascertain that said suction accumulator holds a certain quantity of a relevant pure refrigerant from the very start of the recovering operation. Thereby, when the operation starts, the first thing to happen will be that this amount of pure refrigerant will start to evaporate by the suction pressure of the compressor, thereby immediately causing a lowering of the temperature in the suction accumulator. The resulting gaseous refrigerant will be passed through the subsequent cleaning system, but since it is already clean it will not in any way affect the cleaning system, not until the contaminated refrigerant from the external source starts entering the system. At this time, the temperature in the suction accumulator will already have decreased noticeably such that the recovered refrigerant, right from the start of the intake thereof, will appear with the desired low temperature and with an associated low vapour pressure, which promotes the removal of the refrigerant from the external source. Thus, the contaminated refrigerant from the external source will be conditioned for an efficient purification right from the beginning of it being sucked into the suction accumulator, and this conditioning will in no way affect adversely the final result when care is taken that the suction accumulator is prefilled with an amount of a substantially non-contaminated refrigerant.

Depending on the capacity of the suction intake it may happen that the associated cooling of the suction accumulator proceeds to a temperature level, which is undesirably low for a correct handling of the gas through the following purification stages. In such special cases, of course, the temperature of the gas emanating from the suction accumulator may be raised by adding heat to the accumulator, preferably by arranging for a heating blanket to surround the accumulator container and to be energized by external electrical energy whenever required.

Thus, the supply of such a heating energy to the suction accumulator will not be a general operative condition, but merely a measure for securing that the initial temperature of the fluid to be purified is not too low, should it tend to be so.

Figure 2:
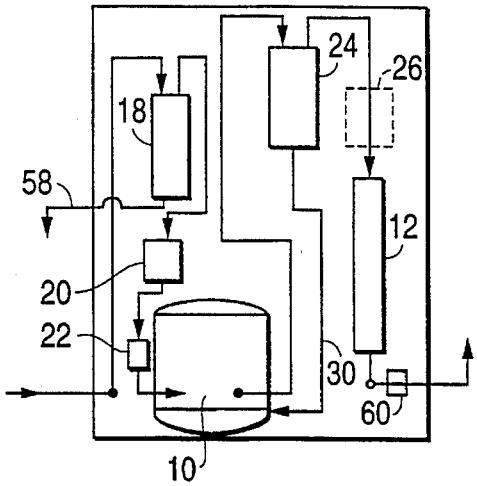
Figure 3:
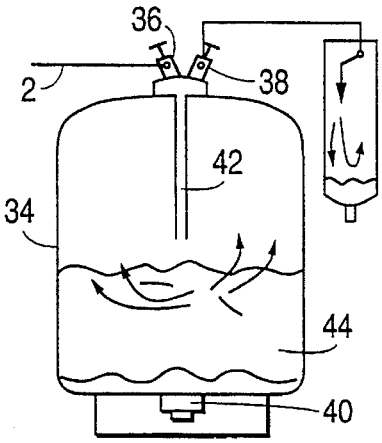
Figure 4:
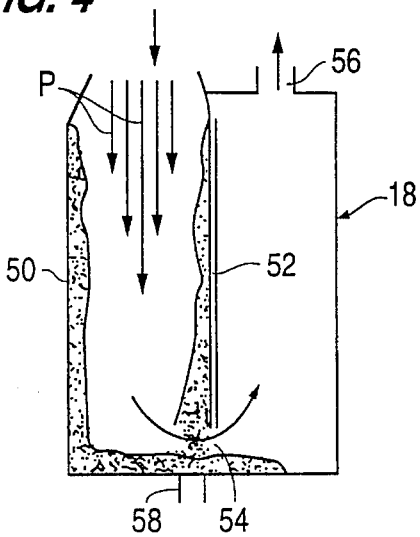
Figure 5:
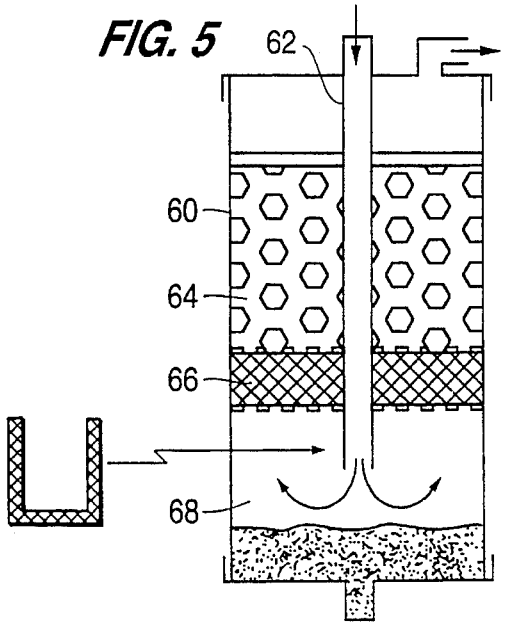

In the following, the invention will be described in greater detail with reference to the drawings, in which:

FIG. 1 is a schematic view of a purification system according to the invention, FIG. 2 is a similar view of a unit of the system, FIG. 3 is a schematic sectional view of another unit of the system, FIG. 4 is a similar view of a third unit of the system, and FIG. 5 is a similar view of a fourth unit of the system.

In FIG. 1, a complete system according to the invention is indicated inside a frame of dotted lines. It is adapted for connection with an external source A of used refrigerant to be recovered and purified, an intake being shown at 2. FIG. 1 illustrates three major units, viz. an intake accumulator 4, a processing unit 6 and a collector tank 8 for purified liquid refrigerant.

The processing unit 6, which is shown in more detail in FIG. 2, comprises a compressor 10 and a condenser 12, indicating that the refrigerant from source A has been taken in, by suction, in its gaseous phase and, having passed several purification devices, is then delivered to the tank 8 in its liquid phase.

On the suction side of the compressor 10, the following devices are arranged in series, seen from the intake accumulator and onwards:

a mechanical oil/acid separator 14;

a filter unit 16 mounted externally on the processing unit 6;

and further inside this unit:

an oil separator 18;

a filter 20;

a suction pressure regulator 22.

Between the discharge side of the compressor 10 and the condenser 12 a combined moisture filter and oil separator 24 is arranged, and the dotted lines indicate that a subsequent drying unit 26 could also be provided.

Between the condenser 12 and the collector tank 8 a moisture filter 28 is interposed cooperating with the liquified refrigerant.

The different devices are described in more detail below, but it should be mentioned already at this point that they are specialized as follows:

Device 4 is a suction container, separator and distillation chamber in which some moisture, most solids, and a large fraction of heavier organic acids and oil are removed from the flow of gaseous refrigerant.

Device 14 is a separator removing almost all lighter components of oil and most of the organic acid from the gas.

Device 16 is a molecular sieve removing almost all remaining acid and a large portion of remaining moisture from the gas.

Device 18 is a separator for removing more acid and oil from the flow.

Device 20 is a combination filter which is active for separating oil and acid and for filtering oil mist and moisture from the flow.

Device 24 is a combined acid and moisture filter and oil separator returning oil to the compressor 10 through a pipe 30.

Device 26, if applied, is a drying system such as disclosed in U.S. Pat. No. 5,094,087.

Device 28 is a final acid and moisture filter or dryer.

The collector tank itself, device 8, is to be regarded as a purifying device as contaminating air and other non-condensible gasses are vented from this tank through an upper outlet 32.

From the above, it can be summarized that the refrigerant is cleaned for water in five different devices (device 26 not included), while oil is dealt with also in five different devices. Organic acid is removed in six devices and hydrochloric acid in four devices. Particulate is removed primarily in the distillation unit 4, but also in the units 14,16,18,20,24 and 28.

It will be clear that especially oil and water could be dealt with to an acceptable degree in less than five devices, but according to the invention it is highly preferable that the oil and water be removed practically totally under all circumstances, such that the system will be universally usable. Similarly, one of the important functions of the intake accumulator 4 is to effect removal of the heavy components of organic acids; thus, if the substance to be processed is known to be free of acid it can be considered to use a system without the accumulator 4. On the other hand, if that would be a basic system, it will be easy to install such an external accumulator if it is no longer sure that the media to be treated will always be substantially free of acid. The acid may have developed in an initially clean refrigerant merely by some excessive heating of the refrigerant, e.g. in connection with a burnt compressor motor, and the entire reclaiming system will normally be vulnerable to internal acid attacks. The unit 4, therefore, should be used in all instances where the media to be handled might contain acid to any damaging degree.

In a system for general use, the unit 4 is an important component for more than one reason. Basically, as shown in FIG. 3, it is just a tank 34 having a top inlet 36, a top outlet 38 and a bottom outlet 40, which is normally closed. The tank 34 may have a relatively large volume, for example some 20–40 liters, and it has been found advantageous to produce it as a modified pressure cylinder, which will fully resist the internal suction pressure from the compressor 10.

According to the invention the inlet 36, to which the intake pipe 2 is connected, is provided with a depending tube 42 projecting a distance down into the tank 34, and the tank is pre-charged with a certain amount of liquid, clean refrigerant 44, e.g. 2–10 liters, and preferably about 5 pounds in a 30 pound cylinder, the surface of the refrigerant being located beneath the lower end of the inlet tube 42. The provision of the tube 42 and the pre-charging 44 are novel features of outstanding significance, which will now be explained in more detail:

As mentioned, it is already known to use a "suction accumulator" 4, viz. for the primary purpose of collecting intake liquid to prevent it from reaching and damaging the compressor. Once some liquid is collected, the liquid will boil by the low pressure in the tank, and the resulting vapors are sucked away to the compressor. Thereby the accumulator acts as distillation chamber, in which some contaminants such as solids and some water and acid will be left in the liquid. Moreover, the liquid acts as a buffer that will stabilize the flow of gas to the compressor and thus provide for stabilized operational conditions. However, it may take some time before a noticeable amount of cold liquid has been collected, and during the initial phase of the operation the temperature of the accumulator will drop relatively slowly due to thermal inertia. During the initial phase the system will thus not operate ideally, partly because the vapor pressure is high due to the temperature being high, such that the suction capacity is low; and partly because under these conditions the separation effect of the accumulator is rather poor; the said destillation becomes ineffective when intruding liquid or gaseous contaminants assume a relatively high temperature, at which they may vaporize vividly by the low suction pressure.

Now, in handling large amounts of refrigerants it could be acceptable that the capacity as to suction and cleaning would not be the best during some initial phase, but when smaller amounts are treated and the requirements as to the total purification are made stronger, then the described results will be unacceptable.

When, according to the invention, the accumulator tank 34 is pre-filled with the charge 44 of a pure refrigerant a brisk boiling thereof will be an immediate result of the compressor being started. Preferably, the inlet 36 should be kept closed during such an initial phase, only during e.g. ½–2 minutes, as the boiling or evaporation will soon provide for a low temperature of the entire unit. The associated "initial vapor" will pass through the whole system, but it will not give rise to any inefficiency, because it was already clean. It will eventually be collected in the tank 8 without having caused any malfunctioning of the various filter means. When the inlet 36 is opened, the desired low temperature of the unit will already have been established. Thus, the vapor pressure is low, whereby the suction will be effective right from the beginning, and because also the temperature is low the contaminants will evaporate at a reduced rate from the very beginning, such that the distillation process becomes more efficient.

In fact, it is possible to control the system in such a manner that the temperature of the unit 4, that is the tank 34 and its contents of pure refrigerant 44, is slightly below zero degrees Celcius, when the inlet 36 is opened. This implies that any incoming water fraction will freeze to ice, whereby any following evaporation is highly retarded.

The tube 42 is important because it will serve to control the concentration of the incoming flow. The process occurring inside the distillation chamber requires that incoming refrigerant be diffused over the entire cold surface of the pre-charge. This is particularly true at the initial stages of the process when the relative amount of refrigerant in the chamber is low and the coldest area may be evaporating surface. This is why the process is described as "Cold Surface Distillation". Later, as the volume of liquid is higher, the contaminated refrigerant can be directed more as a "beam" penetrating the liquid surface to a colder area most likely nearer the core of the liquid mass. By this "shooting down" of the intake medium into the cold bath 44 it is obtained that certain contaminants will be transferred from a gaseous state directly into a solid state, e.g. as "ice", whereby they will not readily evaporate by the low suction pressure of the compressor. The tube should be long enough to ensure that the fluid is delivered as a real beam, but normally a few inches will be sufficient.

To secure the said freezing action in the bath 44 the temperature should be controlled so as to be below 0° C., this being a matter of adjusting the suction pressure in the tank 34. Generally, a very low pressure and temperature does not promote a high vapor flow capacity, but it has been found that it is possible to establish the freezing temperature without any undue limitation of the capacity. Refrigerants typically have pressures of at least 25 PSI at 0° C., whereby the pressure inside the tank can be sufficiently high for maintaining reasonably high vapor flow rates out of the tank without sacrificing the very pronounced precipitation function of the cold bath 44. If, in operation, the pressure tends to decrease to some 10 PSI it is advisable to supply external heat to the tank, e.g. simply by means of a common electrical heating blanket on the outside of the tank. However, such heating should be effected only for a limited time and only when necessary; the need of heating will merely be indicative of the operational conditions not being properly adjusted.

It is particularly advantageous to make use of the said pre-charging of the tank 34 when small amounts of fluid are to be processed, so as to make the destillation highly effective right from the beginning. The charge may not have to be replaced by pure fluid before each and every operation, if the single operations are of short durations. The charge may then be discharged through the bottom outlet 40 and be changed whenever required for an effective pre-cleaning of the treated fluids. Recharging may take place through a non-illustrated connection from the collector tank 8 to the tank 34, or, of course, from container means for virgin refrigerants.

When handling large amounts of fluid it will be less critical to start with a pre-charged tank 34. If the tank is empty from the beginning some liquid 44 will soon be collected in the tank, and the process is easily controlled such that this liquid is built up to the desired volume and then kept at the desired low temperature. Admittedly, the cleaning of the fluid will not be highly effective during the very initial phase of this operation, but in view of the subsequent high efficiency of the purification the result may nevertheless be highly acceptable. After the processing of the large fluid volume, of course, the charge 44 with its captured contaminants may be discharged through the bottom for destruction.

Due to the operation of the discussed pre-cleaning module 4 the intake fluid is cleaned initially to such a degree that the following filters and separators of the entire system can be devoted to high efficiency operation, without being particularly bulky or heavy. As is well know, it may require a very refined system to clean a substance entirely, once it has been coarsely cleaned, and the present system is to be viewed in this manner.

Immediately after the unit 4, directly associated therewith, there is arranged an in-line mechanical separator 14 operating as a scrubber that will precipitate almost all of the lighter components of oil and most of the organic acid still left in the outlet fluid from the unit 4. The scrubber may be of a conventional design, either as a replaceable unit of very high efficiency or a permanent unit with a somewhat lower efficiency. It has a bottom drain, from which the precipitant can be removed for destruction as hazardous waste. Preferably, it is mounted close to the unit 4, as it is regarded as performing a second stage of the treatment in the unit 4.

The following unit 16 is a combination filter holding a relatively large quantity of activated media having an affinity for acid, along with another large quantity of molecular sieve desiccant that removes moisture. This pre-filter, which is disposable as a whole, greatly contributes to clean the fluid to such a high degree that the subsequent parts of the system may concentrate on the removal of the last small fractions of the contaminants. Also, the system will be protected against damages caused by intruding acid. Thereafter, the fluid is let into the processing unit 6, in which the fluid will first meet the oil separator 18, then the filter unit 20, a suction pressure regulator 22 and the compressor 10. It has been found that for a high quality purification it is advantageous to make use of the filter/dryer unit 20 at the cold suction side of the compressor, whether or not a corresponding unit 26 is used additionally on the hot side. However, the desiccant of a filter dryer is liable to be inefficient if contaminated by oil, so while the unit 18 was originally meant to be a more or less ordinary "suction accumulator", it has been endeavoured—with success—to design it in such a manner that it is able to separate oil with a very high efficiency. According to the invention, another advantage of a practically total removal of oil before the fluid enters the compressor 10, where it is again oil wetted, is that the oil present in the intake fluid is not always compatible with the oil of the compressor, whereby, over the time, the compressor oil itself could be adversely contaminated.

A preferred embodiment of the unit 18 is illustrated in FIG. 4. It is a simple container 50 in which is mounted a partition plate 52 extending from the container top and parallel with the downflow direction of the fluid as indicated by arrows P, the lower end of plate 52 being located somewhat above the bottom of the container 50 to define a passage 54, through which the fluid flow may continue upwardly at the other side of the partition plate 52, up to a suction outlet 56 at the top of the container.

An important feature is that, at the inlet side, the cross sectional area between the parts 50 and 52 is sufficiently large to condition the formation of a laminar fluid flow. In such a flow there is a velocity profile where the velocity tends to decline to zero at the boundary layer nearest the stationary surfaces, the said profile being represented by the velocity vector arrows P. At the boundary layer, once the stationary surface is "wetted" with oil, the surface tension of the accumulated oil tends to attract additional contaminated refrigeration fluid, and the oil simply flows down along the side plates and collects at the bottom, from which it is drained off when required, through a pipe 58. The central part of the flow contacts the bottom oil layer and is thus also cleaned. The flow may leave the container with an oil content less than 1% of the original content, which is a remarkable result obtained in a very simple way.

It is important that the container 50 be proportioned with sufficient width to condition the laminar flow. If the flow becomes turbulent the result will be just the opposite, the flow then tearing off oil accumulated on the plate surfaces and mixing it into the refrigerant fluid. For maximum performance the cross section should be oblong, e.g. with a small distance between the plates 50 and 52, in order to ensure a high degree of surface contact of the flow, but of course care should be taken to avoid any substantial suction pressure drop across the unit.

It is well-known to effect an oil separation by a change of direction of the oil carrying flow, and this principle has already given rise to a refined technique, by which the fluid to be cleaned is passed through a screw-wound channel, e.g. a tube having a corkscrew-like insert, whereby the centrifugal force of or in the flow will cause the oil particles to be slung out over a relatively long stretch of the flow, this is effective for a coarse cleaning of the flow, but not at all for a very fine cleaning as aimed at here. However, it has been found that the screw-wound channel is perfectly usable anyhow, also for the present fine-cleaning purpose, viz, when used in connection with the said "Laminar Flow Boundary Layer Oil Separation"-principle as disclosed above. When care is taken that the flow is kept slow and substantially non-turbulent (a truly laminar flow is hardly possible in a screw shaped flow), then the flow will pass along the channel walls over a relatively long length without any turbulence creating interruption, i.e. the flow will sweep over a large surface area with modest space requirements, and the oil mist is effectively precipitated on the large surface. Again, this is not due to the centrifugal force, as conditions creating any substantial centrifugal force would rather destroy this desired result of the "laminar flow boundary layer oil separation".

In small size suction accumulators the vertical plate arrangement as exemplified by FIG. 4 will be preferable, while the described screw channel system may be more useful in large size accumulators or separators of high capacities.

In some instances, e.g. if the portion of refrigerant to be treated is known to be small, e.g. less than 1.5 kg and is known to be relatively free of acids and high levels of moisture, it may be permissible to connect the supply source A directly to the unit 18, through a bypass conduit 3 as shown in dotted lines in FIG. 1. Particularly for that reason it is relevant to regard this unit as a "suction accumulator" functioning somewhat like the unit 4.

The filter unit 20 is a combined filter having in a common housing an oil mist filter and a subsequent moisture absorbing filter holding a molecular sieve material. The oil mist filter precipitates the remaining oil, thus keeping the moisture filter operative. No oil drain is provided, as the filter is adapted to be replaced as a whole when it is time to renew the moisture filter, whereby the collected oil is also disposed of.

Admittedly, the two functions of this combined unit 20 are known when performed in respective separate units, but the building together of such units, according to the invention, amounts to a noticeable advantage because the compact structure will promote the maintaining of a low temperature of the fluid on the suction side of the compressor 10. When the temperature is kept low the filtration means will be more effective, because of the associated lower dew point of the moisture, and for this reason the combined filter unit 16 shows a remarkable cleaning effect. Moreover, the combined unit will of course be less expensive and be easier to mount, compared with three single units.

From the discharge side of the compressor 10 the fluid, now as a hot gas under high pressure, is supplied to the filter and oil separator unit 24, the primary function of which is to remove the oil that has been added to the gas by the flow passing the compressor 10. There exists a standard oil separator for this purpose, but according to the invention a special separator has been developed, viz. combined with a moisture filter. Such a unit is illustrated in FIG. 5. It comprises a housing 60 having a central downlet pipe 62 which passes through two filter chambers 64 and 66 and has its lower end located in a bottom chamber 68, which will thus act as an oil separator when the gas flow from the pipe 62 is deflected at the bottom. The flow then flows slowly up through the filter 66, which is an oil mist filter, from which the collected oil drips to the bottom, and then through the filter 64, which is a moisture absorbing filter. From the bottom, the oil is returned to the compressor 10 through the pipe 30.

The combination filter 20 at the suction side is made up in a similar manner, although without the oil separator section. What was said about the efficiency of the unit 20, due to it keeping the temperature low, will also and even more apply to the unit 24, now for keeping the temperature high and even for including a third component, the oil separator, as an integrated part. It is even preferred to provide the unit 24 with an outer heat insulation.

Almost by coincidence, the same condition as to the gas temperature being close to the dew temperature of the moisture component will prevail in both of the units, at the respective pressure levels, so the filter efficiency is high, also on the hot side. Moreover, the high pressure and temperature at this side will condition a noticeably reduced gas velocity enhancing the filter efficiency even more.

The unit 24, apart from its special cleaning effects at the high pressure and temperature stage of the gas, has the important effect of precipitating the oil that has been added to the gas by its passage of the compressor 10. This ordinary oil separator function is effected with high efficiency, and the oil mist filter serves to do away with the last parts of this oil. The separated oil is returned to the compressor through the pipe 30.

Thereafter the hot gas will be very clean and dry, and the subsequent cleaning/drying stage 26 will not always have to be used. However, if or when it is installed and used, the result will, of course, be still better.

The gas is then delivered to the condenser 12, whereby it leaves the unit 6 in a cooled, liquid state. Preferably the flow passes through a moisture indicator 60 of a known type enabling the operator to check that the moisture is as low as required. The condenser 12 cooperates with a large capacity fan that will serve to cool the fluid not only to the condensation temperature, but even to sub-cool it so that any air and other non-condensables are quickly released.

Finally, the refrigerant exits the system 6 and passes through the external filter unit 28 on its way to the collector tank 8.

This external filter unit 28 corresponds widely or even fully to the external unit 16 at the intake side of the system 6, mainly devoted to the removal of moisture from the refrigerant. Admittedly, in the general prior art the efforts of cleaning the refrigerants have been concentrated on the condensed, liquified state of the fluid, so the mere use of a moisture filter at this place is not novel. However, it is indeed novel to arrange for moisture removal at all of the three major stages of the fluid, viz. 1) when it is a cold suction gas; 2) when it is a hot and pressurized gas; and 3) when it is a cooled liquid. In connection with this invention it has been found that the filter/dryer efficiency is affected by BOTH the ambient temperature and the location. The low pressure gas filter efficiency increases inversely with ambient temperature. The high pressure gas filter efficiency increases proportionally with ambient temperatures. The liquid phase filter efficiency is relatively insensitive to ambient temperature because the refrigerant is a higher density. By combining all three, the purification of the system is not dependent on ambient temperature as losses in efficiency by one filter is made up for by a gain in another.

Having passed the filter unit 28, the fluid is let into the collector tank 8, the liquid fluid now being highly purified except for non-condensable gas such as atmospheric air. As well known, this gas will rise to the top of the tank 8, and as more and more liquid is collected in the tank the gas pressure therein will increase, so that it is required to periodically vent the tank through the blow-off valve 32. Recent developments have concentrated on more or less sophisticated automatic venting arrangements with a view to avoiding a simultaneous blow-out of condensable refrigerant gas but, according to the invention, it may even be preferred to use nothing but a cheap, manually operable blow-off valve 32. An operator or attendant will normally be required anyway, and this person can easily watch a manometer indicating the internal tank pressure. When the pressure goes high, the operator can actuate the valve 32 to open through short intervals of time, whereby the uppermost, non-condensable gases will be blown out without any substantial proportion of condensable refrigerant gas.

All this is a result of close studies, according to which it has been found that the gas at the top of the tank 8 is rather clearly stratisfied in a lower fraction holding the condensable gas and an upper fraction of non-condensable gas. Therefore, it is even preferred to make use of a simple manual valve 32 and prescribe various measures for promoting the venting of non-condensable gas only. Thus, the valve is to be opened slowly and gradually and not violently and it should be opened at intervals as long as possible, the tank should be cooled in order to minimize the proportion of condensable gas and, at the intake side of the system, it should be endeavoured to charge liquid rather than vapor into the system, as this normally will imply en extreme reduction of the air intake.

The described system may be modified in several respects, particularly if it is known that a given system will not need to be highly effective over a wide range of operational conditions. Thus, it has already been mentioned that the intake 2 can be connected directly to the unit 6 if the fluid to be purified is known to be free of acid, and of course this will imply that the units 4, 14 and 16 can be left out in a system that is intended to operate with acid free fluid only. Likewise, for the reason just stated, the moisture filter 64 in the unit 20 might be avoided, if a given system is to operate solely at very high ambient temperatures.

Moreover, the single units of the system could be replaced by units of other designs, without departing from the scope of the invention. Thus, for example, the special oil separator 18, FIG. 4, could be replaced by some conventional oil separator without compromising the generally very high efficiency of the entire system, although it is believed that the efficiency could then be just somewhat lower or the price of the system somewhat higher. The same will apply to each of the other units in the system.

The invention represents a multiple stage technology aiming at an extremely high efficiency, and it will be appreciated that the invention is not limited to the presence of each and all of the stages. Even without one or more of the stages, the system may still be very advantageous, just as one or more of the specialized units or stages may be highly advantageous for use in other systems.

We claim:

1. A system for recovering and refining refrigerants, comprising a suction accumulator having an intake for such refrigerant in liquid or gaseous phase, a compressor having a suction side thereof connected to said suction accumulator, while a discharge side thereof is connected to a condenser which, in turn, delivers the condensed liquid gas to a collector tank, an oil separator being mounted downstream of said compressor before the condenser and connected so as to return separated oil to the compressor, and filter means for the removal of contaminants from said refrigerants being arranged in the connection between the suction accumulator and the collector tank, wherein moisture absorbing filter means are arranged both at the suction side and at the discharge side of the compressor and at said discharge side both between the compressor and the condenser and between the condenser and the collector tank, and wherein said suction accumulator includes means for precleaning the intake refrigerant to remove contaminants therefrom by distillation, said means for precleaning providing an efficient distillation of the intake refrigerant from the beginning of the recovery of said refrigerants.

2. A system according to claim 1, in which an additional oil separator is arranged at the suction side of the compressor, said oil separator and said additional oil separator are upstream of respective ones of said moisture absorbing filter means.

3. A system according to claim 1, wherein said means for precleaning includes an initially pre-charged amount of an at least substantially clean or purified refrigerant in said accumulator.

4. A system according to claim 1, wherein said accumulator is made as a tank unit having a bottom outlet for precipitants, a top outlet for discharge gas, and a top inlet for a contaminated fluid, said top inlet being connected with a pipe member extending downwardly from the tip inlet to a level spaced above the bottom of the tank.

5. A system according to claim 1, wherein said oil separator comprises a flow-through housing having a cross sectional shape conditioning the through flow to be substantially laminar with oil being removed from the through flow primarily by precipitation of oil mist on a surface with a boundary layer where the flow does not change direction.

6. A system, according to claim 1, in which at least one of the moisture absorbing filter means contains a molecular sieve material and is designed as a combination filter also housing an oil mist filter and an oil separator unit.

7. A system according to claim 6, in which the combination filter is mounted between the discharge side of the compressor and the condenser and is heat insulated.

8. A system according to claim 1, further comprising an oil/moisture/acid separator including a tank unit having a bottom outlet for precipitants, a top outlet for discharge gas, a top inlet for a contaminated fluid, and a pipe member connected with said top inlet and extending downwardly from said top inlet to a point within said tank unit and above the bottom of the tank unit.

9. A system according to claim 1, further comprising an oil separator including a flow-through housing having a cross sectional shape causing the through flow to be substantially laminar.

10. A system according to claim 1, wherein said means for precleaning removes contaminants of moisture, solids and heavier organic acids and oil from said liquid.

11. A system according to claim 1, wherein said means for precleaning provides a cold surface in said accumulator at the beginning of the recovery of said volatile fluid and includes means for diffusing the incoming volatile fluid over said cold surface.

12. A system for recovering and refining refrigerants, comprising a suction accumulator having an intake for such refrigerant in liquid or gaseous phase, a compressor having a suction side thereof connected to said suction accumulator, while a discharge side thereof is connected to a condenser which, in turn, delivers the condensed liquid gas to a collector tank, an oil separator being mounted downstream of said compressor before the condenser and connected so as to return separated oil to the compressor, and filter means for the removal of contaminants from said refrigerants being arranged in the connection between the suction accumulator and the collector tank, wherein moisture absorbing filter means are arranged both at the suction side and at the discharge side of the compressor and at said discharge side both between the compressor and the condenser and between the condenser and the collector tank, and wherein said suction accumulator includes means for precleaning the intake refrigerant to remove contaminants therefrom by distillation, said means for precleaning providing an efficient distillation of the intake refrigerant from the beginning of the recovery of said refrigerants, and in which the suction connection between the intake and the compressor comprises a series of filter/separator units as follows: a combined suction accumulator and water/oil/acid separator, a combined moisture and acid absorbing filter, a highly effective oil separator operable also as a second suction accumulator, and an oil mist and moisture absorbing filter.

13. A system according to claim 12, in which a selectively applicable by-pass conduit is provided between the intake and said second suction accumulator.

14. A system for recovering and refining refrigerants comprising a suction accumulator having an intake for such refrigerant in liquid or gaseous phase, a compressor having a suction side thereof connected to said suction accumulator, while a discharge side thereof is connected to a condenser which, in turn, delivers the condensed liquid gas to a collector tank, filter means for the removal of contaminants from said refrigerants being arranged in the connection between the suction accumulator and the collector tank, and wherein said suction accumulator includes means for precleaning the intake refrigerant to remove contaminants therefrom by distillation, said means for precleaning providing an efficient distillation of the intake refrigerant from the beginning of the recovery of said refrigerants.

15. The system according to claim 14, wherein said means for precleaning provides a cold surface in said accumulator at the beginning of the recovery of said volatile fluid and includes means for diffusing the incoming volatile fluid over said cold surface.

16. The system according to claim 15, wherein said means for precleaning includes an initially pre-charged amount of an at least substantially clean or purified refrigerant in said accumulator which provides said cold surface as a result of evaporation of said refrigerant at the beginning of the recovery of said volatile fluid.

17. The system according to claim 15, wherein said means for diffusing including a pipe member extending downwardly in said accumulator to a level spaced above the bottom of the tank and incoming fluid being drawn through said pipe member for diffusing the fluid over said cold surface.

* * * * *